United States Patent [19]

Lee

[11] Patent Number: 4,976,643

[45] Date of Patent: Dec. 11, 1990

[54] DIRECT-HEATED CATHODE STRUCTURE AND METHOD FOR THE FABRICATION THEREOF

[75] Inventor: Seung J. Lee, Suwon, Rep. of Korea

[73] Assignee: Samsung Electron Devices Co., Ltd., Rep. of Korea

[21] Appl. No.: 430,729

[22] Filed: Nov. 2, 1989

[51] Int. Cl.[5] ..... H01J 9/04

[52] U.S. Cl. ..... 313/276; 313/310; 313/341; 445/29; 228/222

[58] Field of Search ..... 445/29, 36; 313/310, 313/341, 277, 276; 228/222

[56] References Cited

U.S. PATENT DOCUMENTS

| | | | |
|---|---|---|---|
| 3,633,062 | 1/1972 | Tamura | 313/341 |
| 4,388,551 | 6/1983 | Ray | 313/341 X |
| 4,445,399 | 5/1984 | Sasaki et al. | 228/222 X |

*Primary Examiner*—Kenneth J. Ramsey

[57] ABSTRACT

Method of fabricating a direct-heated cathode structure comprising prepunching process wherein fixing segments are inserted to slot in the ceramic base and bended about 45, and finish punching process wherein upper end of prepunched fixing segments are pressed over the ceramic base. Direct-heated cathode structure comprising supporting bars with a supporting protuberance at their upper end and a barricade at their middle to prevent deformation during welding of springs and to confine affection of buckling during electric resistance welding of conductive tape respectively.

6 Claims, 5 Drawing Sheets

DIRECT-HEATED CATHODE STRUCTURE AND METHOD FOR THE FABRICATION THEREOF

BACKGROUND OF THE INVENTION

This invention relates to direct-heated cathode structures which support the direct-heated cathode in a cathode-ray tube and to methods for the fabrication of the direct-heated cathode structure.

A direct-heated cathode structure is an element for use in an electron gun wherein a cathode pellet is heated by a heating element and emits thermions; and the structure is classified into a direct-heated type and an indirect-heated type according to the relative position of the cathode pellet.

In the above statement, the direct-heated type has its cathode pellet itself placed on the filament and the indirect-heated type has its cathode pellet placed on a cap which surrounds the filament thus the cathode pellet contacts the heating element indirectly.

While the direct-heated type and the indirect-heated type have different merits and deficiencies according to their structures respectively, the former when it is compared with the latter is characterized by its simplicity in structure, its low power consumption rate and the fact that the picture appears on the cathode-ray tube screen quickly. It is employed in electric viewfinders for portable small-sized televisions or video cameras.

On the contrary, one of the deficiencies of the direct-heated type is in that the interspace between the first grid and the cathode pellet in the direct-heated type cathode structure varies when the filament emits heat producing tension changes in the filament because of thermal expansion.

The abovementioned thermal expansion which is produced not only in the filament but also in the filament supporting structure, causes dimensional changes in the interspace between the filament and the supporting structure, and in their respective disposition; and these dimensional changes affect the cut-off voltage thus deteriorating the white balance.

As is described in U.S. Pat. No. 3,633,062 as a prior art in order to solve these problems originated from the thermal expansion, a material with low thermal expansion coefficient such as ceramic is adopted. At the same time, the changes of tension in the filament is to be absorbed by supporting both ends of the filament with spring reeds.

FIG. 4 illustrates a general structure of the direct-heated cathode structure with a ceramic base.

The ceramic base 1 has penetration hole 1' at both sides whereto supporting bars 2 are inserted and bonded; springs 3 with their ends bend outwardly are welded to said bars 2 at their upper ends; and a filament 4 is built in between upper ends of said springs 3.

Above mentioned supporting bars 2, as they act as electrical conduit for impressing power to the filament, are made of conductive material and they are inserted through the penetration holes 1' and bonded to the ceramic base 1 by means of frit 5 because welding metal and ceramic together is not feasible.

The cathode pellet 6 is bonded on a base metal formed at the upper center of the filament maintaining some interspace from the first grid 7.

According to this direct-heated cathode structure, the filament 4 when it's impressed by suitable voltage produces heat from 700 Txc to 800 Txc normally thus making the cathode pellet 6 emit thermions toward the first grid 7. As the change in the filament length caused by the thermal expansion during this process will be absorbed by springs 3 at both ends of the filament, the interspace between the cathode pellet 6 and the first grid 7, and their respective disposition seldom experience changes thus the cathode pellet is maintained to face always the center of the first grid.

However, in the above mentioned direct-heated cathode structure, it is not only difficult to maintain the accuracy in assembling the structure but also the number of processes required increases because supporting bars 2 are fixed by sintering to the ceramic base 1 by means of frit 5, and furthermore, a glassy laminar insulator which interrupts the spot welding of the conductive tapes 2' onto supporting bars 2 will be sintered over the surface of the supporting bars if the frit runs down the surface.

In addition to the above, supporting bars 2 will be buckled by the pressure applied during the welding of conductive tapes 2' to the lower ends of supporting bars 2 and as shown by chained line in FIG. 4, there will be some deformation in the respective disposition between supporting bars 2 and springs 3.

Because of the above mentioned deformation, thermal vibration will occur in the filament 4 at the beginning of heating and it is the main reason for the picture noises.

The present invention is directed to provide a direct-heated cathode structure with its supporting bars attached to the ceramic base by mechanical means and an adequate fabrication method for the same.

Also the present invention is directed to provide a direct-heated cathode structure which suffers no deformation in the respective disposition state between its supporting bars and the filament by confining the deformation of the supporting bars that may happen to its lower end portion only during the welding of conductive tape to the supporting bar.

SUMMARY OF THE INVENTION

Accordingly, it is an object of the present invention to provide a direct-heated cathode structure which supports the direct-heated cathode in a cathode-ray tube and to provide a method for fabricating the structure.

The direct-heated cathode structure according to the present invention is characterized in that it includes supporting bars with integrated fixing segments at their upper portion and a ceramic base with slots at both sides whereto said fixing segments will be joined by bending.

Supporting bars in the above mentioned direct-heated cathode structure have a supporting protuberance at their upper end to prevent deformation during welding of springs and a barricade at their middle to confine the effect of the buckling that occurs during the electric resistance welding of conductive tape within their lower portion.

The fabrication method for the above mentioned direct-heated cathode structure in this invention is featured by a prepunching process wherein fixing segments are inserted to slot in the ceramic base and bend about 45 degrees, and a finish punching process wherein upper end of prepunched fixing segments are pressed over the ceramic base.

BRIEF DESCRIPTION OF THE DRAWINGS

Other advantages and features of the present invention will be clearly understood by an embodiment following in reference to attached drawings.

DETAILED DESCRIPTION OF THE PRESENT INVENTION

Figure 1:
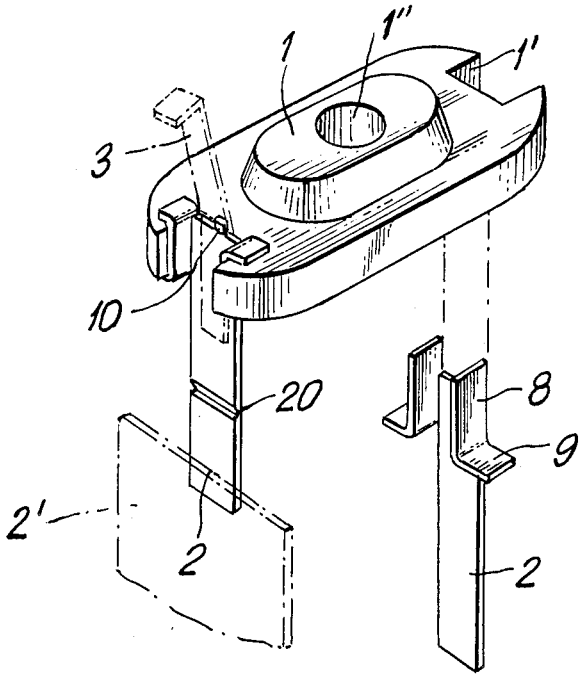
FIG. 1 shows a partially exploded perspective view illustrating the direct-heated cathode structure.
Figure 2A:
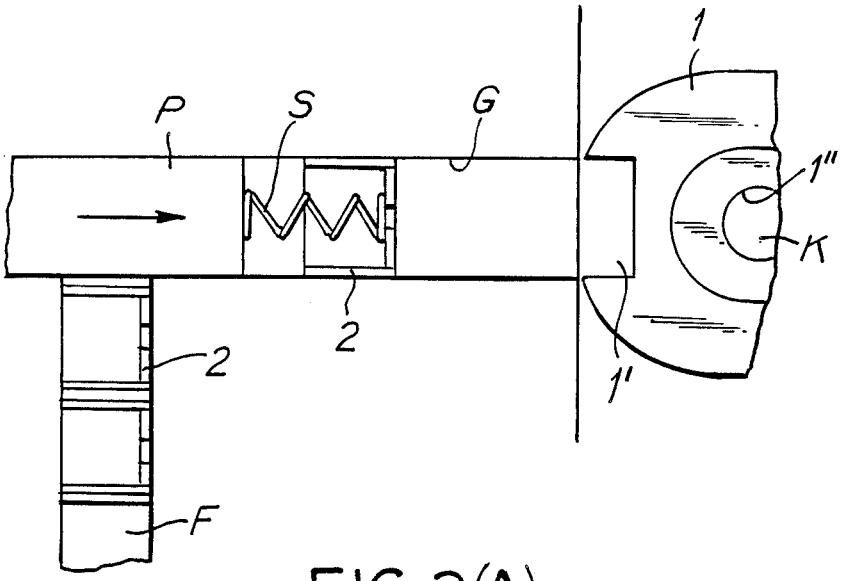
FIGS. 2(A) to 2(D) show processes illustrating the desirable fabrication method of this invention, FIG. 2-A illustrating the assembling of the ceramic base and supporting bars, FIG. 2-B illustrating the prepunching, FIG. 2-C illustrating the bending of fixing segments by prepunching and FIG. 2-D illustrating the finished punching.
Figure 2B:
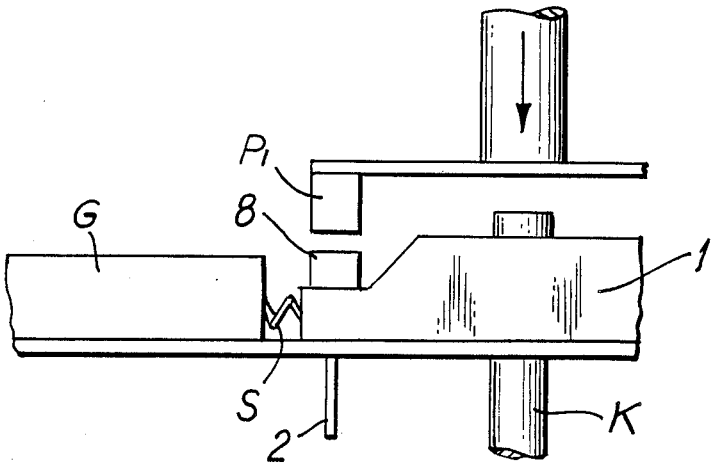
Figure 2C:
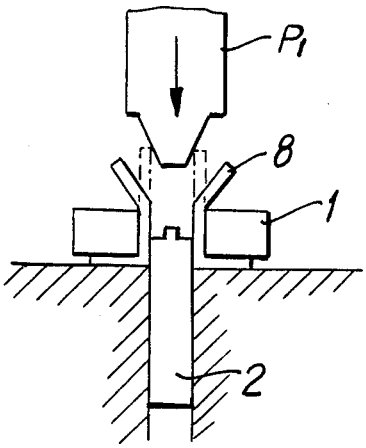
Figure 2D:
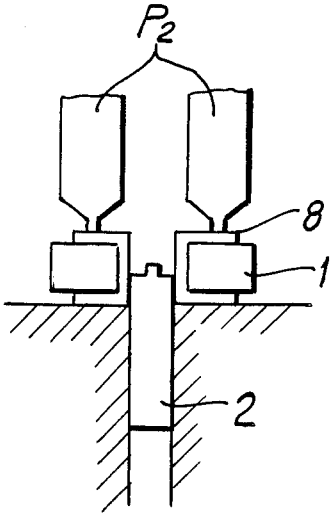

Referring to FIG. 1, the direct-heated cathode structure includes a ceramic base 1 with slots 1' formed at both sides and supporting bars 2 with integrated fixing segments 8 at their upper portion which will be inserted into said slots 1' in the ceramic base 1 and fixed thereto by bending.

Because the filament supporting spring 3 and the conductive tape 2' will be welded to the upper portion and lower portion of supporting bars 2 respectively, a supporting protuberance 10 is formed at the upper end of the supporting bars so as to prevent the deformation of said spring 3 during welding and a groove-shaped barrier 20 is formed at about the middle of the supporting bars so as to confine the deformation by welding of conductive tape 2' to the lower portion of the supporting bars.

Fixing segments 8 are integrally extended paralled to the vertical axis of supporting bars 2 and are bent resulting in a supporting bar 2 which at its upper end is "L" shaped; and lower portion of fixing segments are bent outward forming seats 9.

The above mentioned fixing segments 8 as illustrated in the drawing, will be bent and fixed to the ceramic base in its slots by means of punching.

Thus after supporting bars 2 are fixed to the ceramic base 1; next the filament supporting springs 3 will be welded to bars 2 and they will be supported by supporting protuberance 10 to be set as required; and conductive tape 2' will be connected at the lower portion of supporting bars 2 by welding.

During the welding process, the buckling deformation of supporting bars 2 will be confined to the lower portion by the barrier 20 thus not affecting the upper portion because the groove-shaped barricade 20 at about the middle of supporting bars 2 will react and be bent first of all when buckling deformation is caused by welding pressure.

Consequently the shape of the spring is maintained as it was thus not causing any thermal vibration in the filament at the beginning of its heating.

FIG. 2 illustrates an adequate fabrication method for the direct-heated cathode structure of this invention.

As illustrated in FIG. 2-A, a ceramic base 1 with its penetration hole 1" in the center passed through by an arbor K of a jig is secured at the assembling position; a supporting bar 2 from the feeder F is ejected to slot 1' in said ceramic base 1 one by one by means of an end spring S in a pusher P that reciprocates within a chute G.

Thus said supporting bar 2 is inserted into said slot in said ceramic base; then as shown in FIG. 2-B, a first puncher P1 moves downward from above the ceramic base 1 providing prepunching for fixing segments 8 of the supporting bar 2, with the supporting bar 2 not being shaken within the slot 1' of the ceramic base 1 as it is pushed elastically by said end spring S of the pusher P during this process.

The purpose of the prepunching is to eliminate the remaining stress originated from the bending of fixing segments 8 by an about 45 degree prebending as illustrated in FIG. 2-C, then to get good fixing condition at the subsequent finished punching.

After prepunching, the fixing segment 8 as illustrated in FIG. 2-D is fixed to the ceramic base 1 by a fork-shaped second puncher P2.

In this way the supporting bar of the direct-heated cathode structure in this invention is fixed to the ceramic base without utilizing a frit hence without the possible glassy laminar insulator sintered on the bar surface, also the number of processes relevant to the sintering is saved.

Furthermore while the accuracy in assembling the supporting bar was bad in the prior art because of the repeated heat-expansions and cool-shrinkages during the sintering process, we had the sintering process omitted in this invention resulting in good accuracy in assembling the cathode thus having its electric characteristic guaranteed; and also the buckling deformation during the welding of the conductive tape does not affect the upper portion of the supporting bar because it is absorbed by the barrier, thus the shape of the spring fixed at the upper end of supporting bars does not become distored under any circumstance.

Figure 3A:
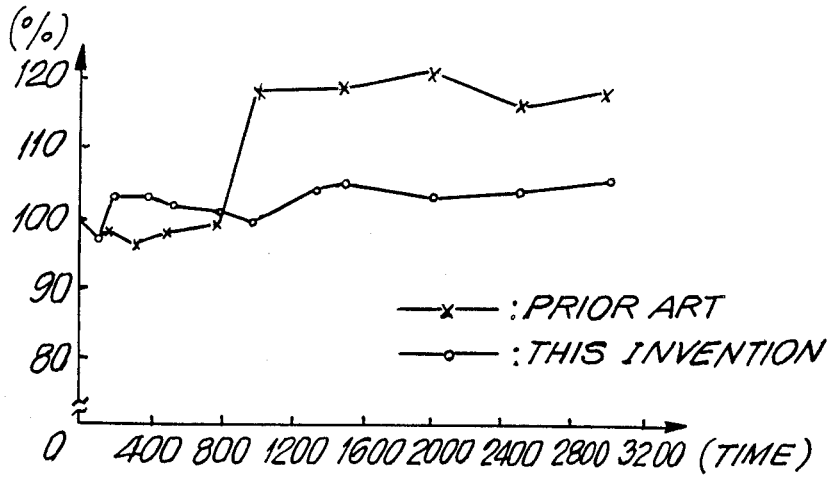
FIGS. 3-A and 3-B show graphs for the comparison of performance between the direct-heated cathode structure of this invention and the cathode structure of the same type in the prior art, FIG. 3-A illustrating the change of cut-off voltage and FIG. 3-B illustrating the change of emission.
Figure 3B:
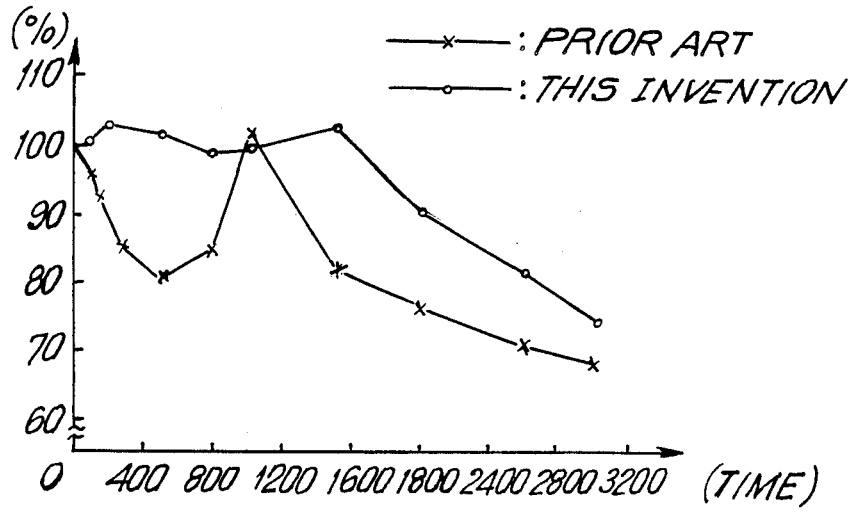
Figure 4:
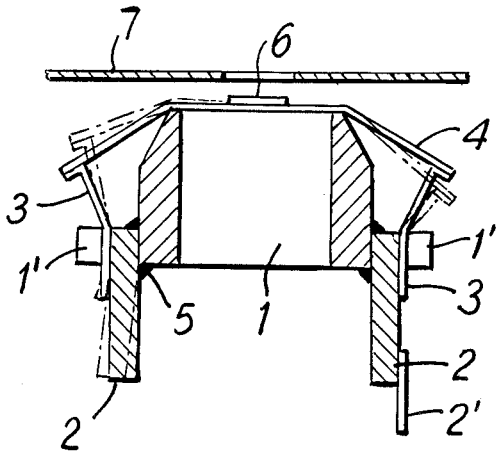
FIG. 4 shows a cross-sectional view of a direct-heated cathode structure in the prior art whereto a ceramic base is affixed.

In the performance comparison graphs as shown in FIG. 3, FIG. 3-A shows the result of cut-off voltage calibration wherein the filament is repeatedly impressed to a rated voltage by operation of switching on and off for 20 minutes and 4 minutes respectively, and FIG. 3-B shows the result of emission change calibration according to the cut-off voltage.

To explain the result of calibrations, the cut-off voltage in the present invention shows an excellent characteristic with its degree of variation almost negligible while that in the prior art abruptly varies after 1,000 hours of use.

In emission change, the present invention maintained the change of 90% while one in the prior art showed an abrupt decrease to 80% after 1,000 hours of use; and also the variation rate of cut-off voltage according to aging was calibrated to show from 5% to 10% by the present invention while it was calibrated to show from 15% to 20% by one in the prior art thus an enhanced result in obtained by the present invention.

The above calibration results show that the direct-heated cathode structure of this invention has a more homogeneous resisting characteristic against thermal shock and it has a better endurance against thermal shock than one in the prior art.

What is claimed is:

1. A cathode capable of being heated directly, comprising:

a ceramic base having spaced slots at the circumference thereof;

supporting bars;

and fixing segments mechanically connecting said supporting bars respectively to said ceramic base, said fixing elements being respectively inserted into, and bent around, the slots of the ceramic base.

2. The cathode structure according to claim 1, wherein the said supporting bars have a supporting protuberance at an upper end thereof in order to support a filament supporting spring of the cathode.

3. The cathode structure according to claim 1 or 2, wherein each supporting bar has a groove shaped barrier at a middle region spaced from the respective slot.

4. A method of fabricating a cathode capable of being sheated directly, and having a ceramic base with a slot, comprising the steps of:

securing the ceramic base in a fixed position;

feeding a supporting bar having fixing segments into the slot; and mechanically fixing said fixing segments around the slot.

5. A method of fabricating a cathode according to claim 4, wherein the supporting bar is pushed into, and held to, said ceramic base by a spring attached to a pusher.

6. A method of fabricating a cathode in accordance with claim 4, wherein said mechanical fixing comprises the steps of:

bending of the fixing segments so that said fixing segments extend at an angle to the ceramic base; and thereafter punching of the bent fixing segments until said fixing segments are flush with said ceramic base.

* * * * *